US006915877B2

(12) United States Patent
Khayalian

(10) Patent No.: US 6,915,877 B2
(45) Date of Patent: Jul. 12, 2005

(54) MUFFLER DEVICE

(76) Inventor: Garabed Khayalian, 2386 E. Del Mar Blvd., Apt. 311, Pasadena, CA (US) 91107

( * ) Notice: Subject to any disclaimer, the term of this patent is extended or adjusted under 35 U.S.C. 154(b) by 0 days.

(21) Appl. No.: 10/342,070

(22) Filed: Jan. 13, 2003

(65) Prior Publication Data

US 2004/0134713 A1 Jul. 15, 2004

(51) Int. Cl.[7] ..... F01N 1/08
(52) U.S. Cl. ..... 181/272; 181/275; 181/251
(58) Field of Search ..... 181/259–275, 181/258, 240, 212; 60/288–302

(56) References Cited

U.S. PATENT DOCUMENTS

| | | | | |
|---|---|---|---|---|
| 3,620,330 A | | 11/1971 | Hall | |
| 3,672,464 A | | 6/1972 | Rowley et al. | |
| 3,851,727 A | | 12/1974 | Getz et al. | |
| 3,880,252 A | | 4/1975 | Mucka | |
| 3,970,168 A | | 7/1976 | Mucka | |
| 4,094,645 A | | 6/1978 | Bailey | |
| 4,108,275 A | | 8/1978 | Black et al. | |
| 4,263,982 A | | 4/1981 | Feuling | |
| 4,484,659 A | | 11/1984 | Buchwalder | |
| 4,538,701 A | | 9/1985 | Lowery et al. | |
| 4,712,644 A | * | 12/1987 | Sun | 181/251 |
| 4,809,812 A | | 3/1989 | Flugger | |
| 4,834,214 A | | 5/1989 | Feuling | |
| 5,033,581 A | | 7/1991 | Feuling | |
| 5,123,502 A | | 6/1992 | Flugger | |
| 5,162,620 A | | 11/1992 | Ross et al. | |
| 5,173,576 A | | 12/1992 | Feuling | |
| 5,304,749 A | | 4/1994 | Crandell | |
| 5,350,888 A | | 9/1994 | Sager, Jr. et al. | |
| 5,351,483 A | | 10/1994 | Riley et al. | |
| 5,355,973 A | | 10/1994 | Wagner et al. | |
| 5,365,025 A | | 11/1994 | Kraai et al. | |
| 5,413,189 A | | 5/1995 | Browning et al. | |
| 5,444,197 A | | 8/1995 | Flugger | |
| 5,457,290 A | * | 10/1995 | Sase et al. | 181/258 |
| 5,659,158 A | | 8/1997 | Browning et al. | |
| 5,828,013 A | | 10/1998 | Wagner et al. | |
| 5,936,210 A | | 8/1999 | Borneby et al. | |
| 6,089,347 A | | 7/2000 | Flugger | |
| 6,241,044 B1 | * | 6/2001 | Nishiyama et al. | 181/272 |

FOREIGN PATENT DOCUMENTS

| | | |
|---|---|---|
| EP | 0 100 139 A1 | 2/1984 |
| EP | 0 530 017 A2 | 3/1993 |
| EP | 0 530 017 A3 | 3/1993 |
| JP | 63186908 A | 8/1988 |
| JP | 03147500 A | 6/1991 |
| JP | 05033627 A | 2/1993 |
| JP | 10018833 | 1/1998 |

* cited by examiner

*Primary Examiner*—David Martin
*Assistant Examiner*—Renata McCloud
(74) *Attorney, Agent, or Firm*—Milord A. Keshishian

(57) ABSTRACT

A muffler device, in one preferred embodiment, having four barriers therein. Each barrier functions to form an within which the exhaust stream can be partitioned and redirected. Eventually, the exhaust streams are once again recombined and expelled from the muffler. The partitioning and reassembly of the exhaust streams provides sound attenuation while increasing the horsepower of the engine and without resulting in any build up of unignited fuel.

17 Claims, 4 Drawing Sheets

MUFFLER DEVICE

FIELD OF THE INVENTION

The present invention relates to the field of mufflers for internal combustion engines in general, and specifically to mufflers in which sound attenuation is achieved with a minimum back-pressure thereby resulting in increased engine horsepower.

BACKGROUND OF THE INVENTION

Mufflers have been developed for the attenuation of the sound component in an exhaust gases from an internal combustion engine which employ sound-attenuating partition configurations that produce low-pressure regions or volumes within the muffler. The low-pressure volume can be the result of cancellation of identical sound frequencies by directing streams of gas to collide against each other, or can be the result of fluid flow patterns through the muffler, or both.

The flow of exhaust gases through a muffler is not in a steady stream of the type which exits a garden hose. Instead, each time an exhaust valve opens, a pulse of exhaust gases is discharged into the exhaust system. Thus, flow of exhaust gases through a muffler is comprised of a series of volume pulses in which there are fully combusted gases, live fire or burning fuel and, in some cases, fuel which is unignited and will not contact or mix sufficiently with the burning fuel to ignite.

When these exhaust components reach the muffler, the muffler partitions typically quench or retard further burning of unignited fuel rather quickly. The result is that a small volume of unignited fuel may be present in the muffler. If the muffler includes low-pressure regions or volumes, there will be a tendency for this unignited fuel to accumulate in such regions.

The presence of a low-pressure volume in a muffler, nevertheless, is highly desirable since in some muffler configurations it has been found to increase engine horsepower. It is believed that the low-pressure region in the muffler is "seen" upstream in the exhaust system to the engine. The low pressure in the muffler scavenges or accelerates the movement of exhaust gas pulses in the exhaust system. Thus, pulses proximate the low-pressure volume are accelerated toward it, which, in turn, accelerates pulses farther upstream. Finally, when the engine exhaust valve opens to exhaust gases from the cylinder, these gases are exhausted into a lower pressure exhaust system than would be present if the muffler did not have low-pressure volumes in it. This slightly lower pressure at the exhaust valve enables the same volume of gases to be exhausted from the cylinder in a slightly shorter period of time. This, in turn, allows the engine to be tuned to keep the exhaust-valve closed slightly longer, which allows the engine to develop additional horsepower.

The accumulation of unignited fuels in mufflers having low-pressure volumes can present a problem which ranges from annoying to potentially dangerous. Under most operating conditions such fuels are either not accumulated or are dissipated. However, under some conditions explosive detonations or rapid combustion can occur. Such muffler explosions can range from disconcerting popping sounds during deceleration to violent explosions which damage the muffler and exhaust system.

Therefore, there remains a long standing and continuing need for an advance in the art of mufflers that is simpler in both design and use, is more effective in allowing an increase in horse power while eliminating the possibility of popping sounds or even explosions, and is cost efficient in its construction and use.

SUMMARY OF THE INVENTION

Accordingly, it is a general object of the present invention to overcome the disadvantages of the prior art.

In particular, it is an object of the present invention to provide a sound-attenuating muffler for an internal combustion engine or the like, and method, which prevents the accumulation of unignited fuel in low-pressure volumes in the muffler without significantly decreasing the sound-attenuating capacity of the muffler.

It is another object of present invention to provide a sound-attenuating muffler and method which prevents accumulation of unignited fuel in the muffler without decreasing the enhanced engine performance produced by the muffler.

It is a further object of the present invention to provide a sound-attenuating muffler which prevents accumulation of unignited fuels in the muffler, yet is still compact and durable, has a minimum number of components and is economical to manufacture.

In keeping with the principles of the present invention, a unique muffler is herein disclosed having a first, second, third and fourth barrier in one preferred embodiment. Each barrier functions to form a compartment within which the exhaust stream can be partitioned and redirected. Eventually, the exhaust streams are once again recombined and expelled from the muffler. The partitioning and reassembly of the exhaust streams provides sound attenuation while increasing the horsepower of the engine and without resulting in any build up of unignited fuel.

Such stated objects and advantages of the invention are only examples and should not be construed as limiting the present invention. These and other objects, features, aspects, and advantages of the invention herein will become more apparent from the following detailed description of the embodiments of the invention when taken in conjunction with the accompanying drawings and the claims that follow.

BRIEF DESCRIPTION OF THE DRAWINGS

It is to be understood that the drawings are to be used for the purposes of illustration only and not as a definition of the limits of the invention.

In the drawings, wherein similar reference characters denote similar elements throughout the several views.

DETAILED DESCRIPTION OF THE INVENTION

Figure 1:
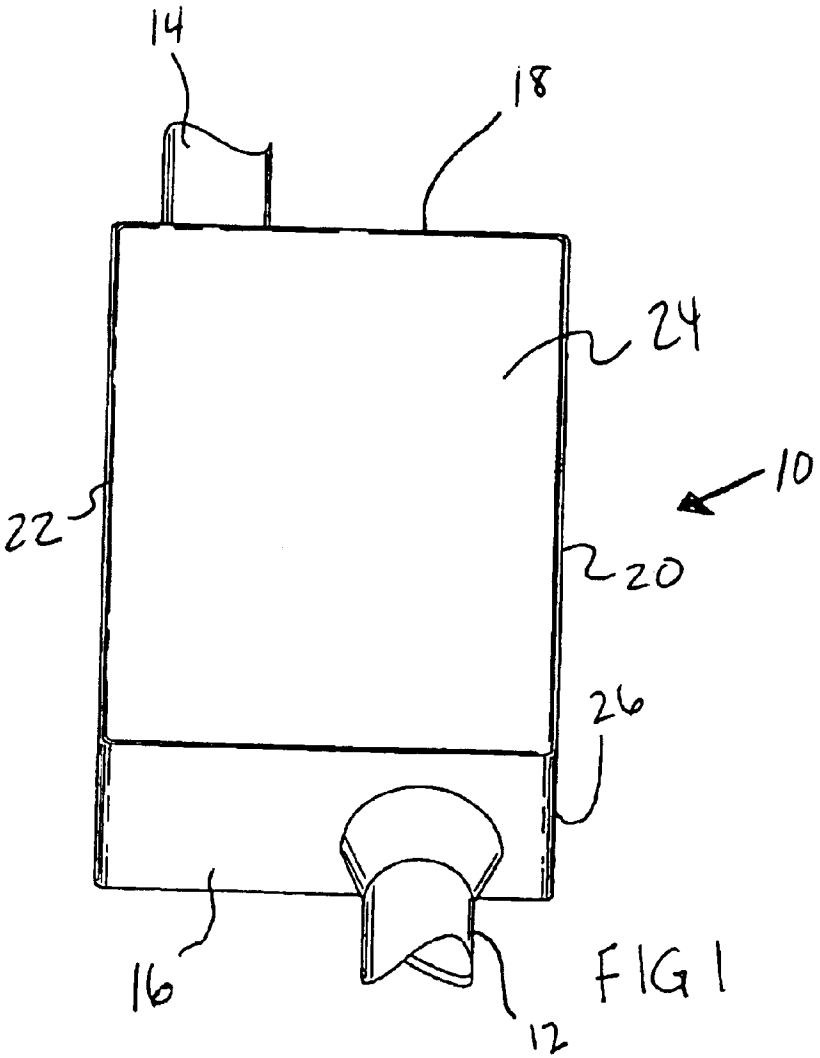
FIG. 1 is perspective view of a muffler device in an assembled state.
Figure 2:
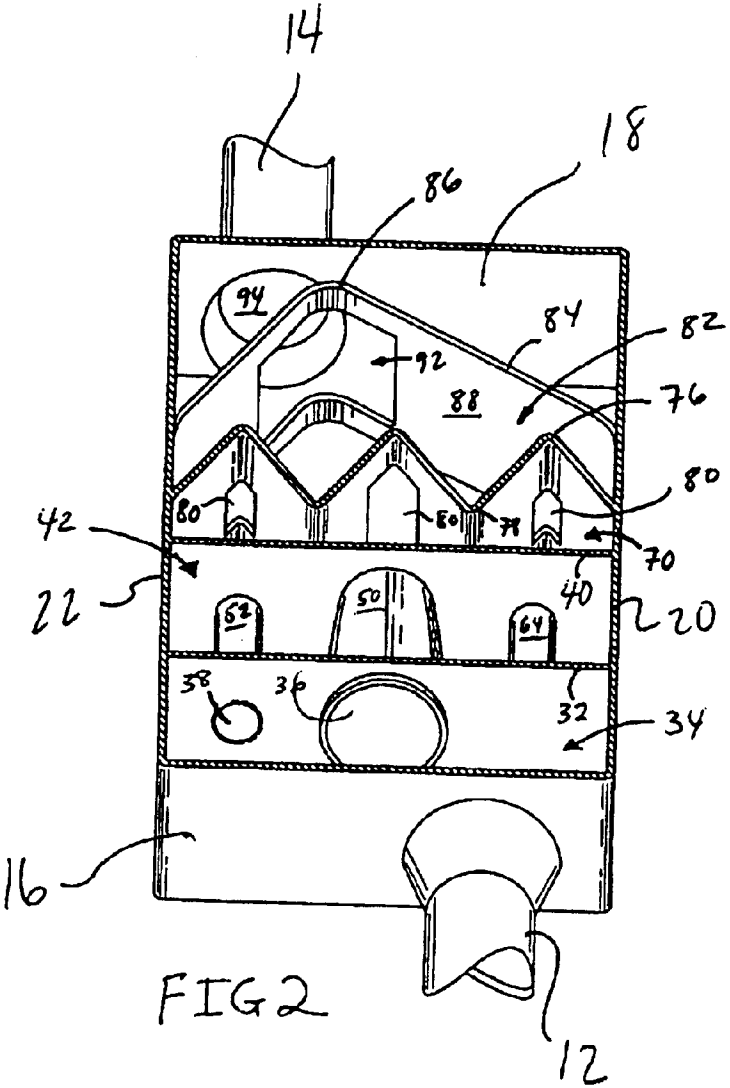
FIG. 2 is a frontal top perspective view of the muffler device with a top thereof removed.
Figure 4:
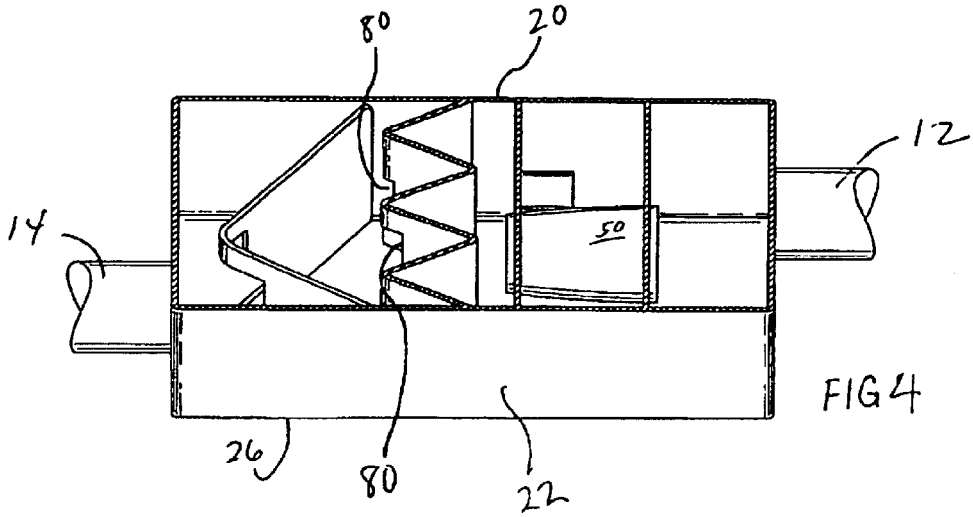
FIG. 4 is a second side top perspective view of the muffler device with the top thereof removed.
Figure 3:
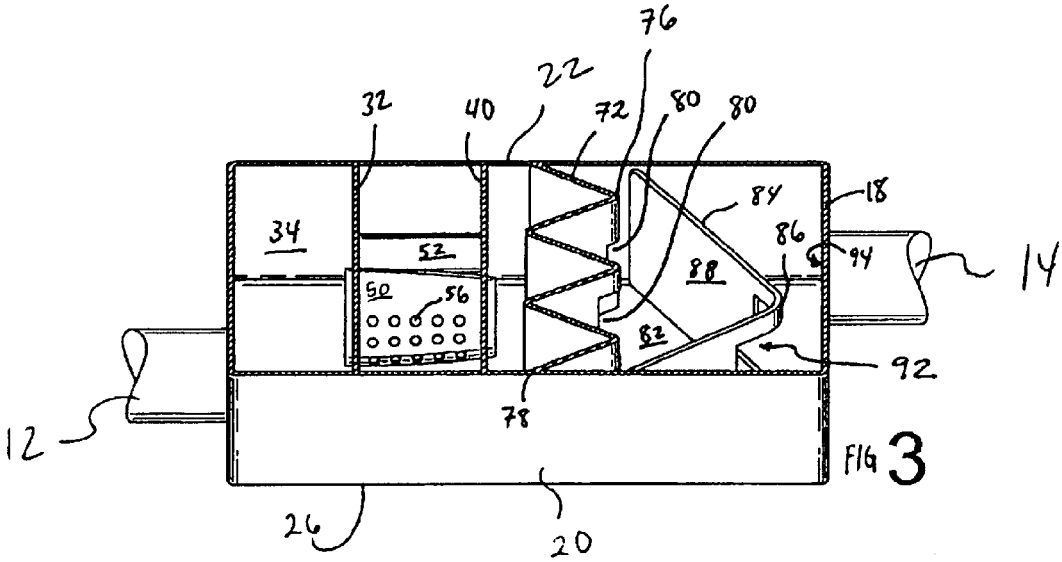
FIG. 3 is a first side top perspective view of the muffler device with the top thereof removed.

Referring to FIGS. 1 through 4, therein is illustrated a muffler device generally designated by the number 10 and having a generally rectangular shape. However, it is to be understood that the shape of device 10 may be altered without departing from the essence of the invention. In addition, the materials described and the dimensions given can be modified to accommodate different engines and physical requirements of other types of vehicles with which device 10 may be used. Device 10 has an inlet conduit 12 and an outlet conduit 14 attached to an inlet wall 16 and an outlet wall 18 respectively, through which walls said conduits 12 and 14 traverse and allow communication there through. Inlet wall 16 and outlet wall 18 are interconnected by a first sidewall 20 and a second sidewall 22. A top 24 and a bottom 26 extend over walls 16, 18, 20, and 22 on opposing sides thereof and enclose the same.

Figure 5:
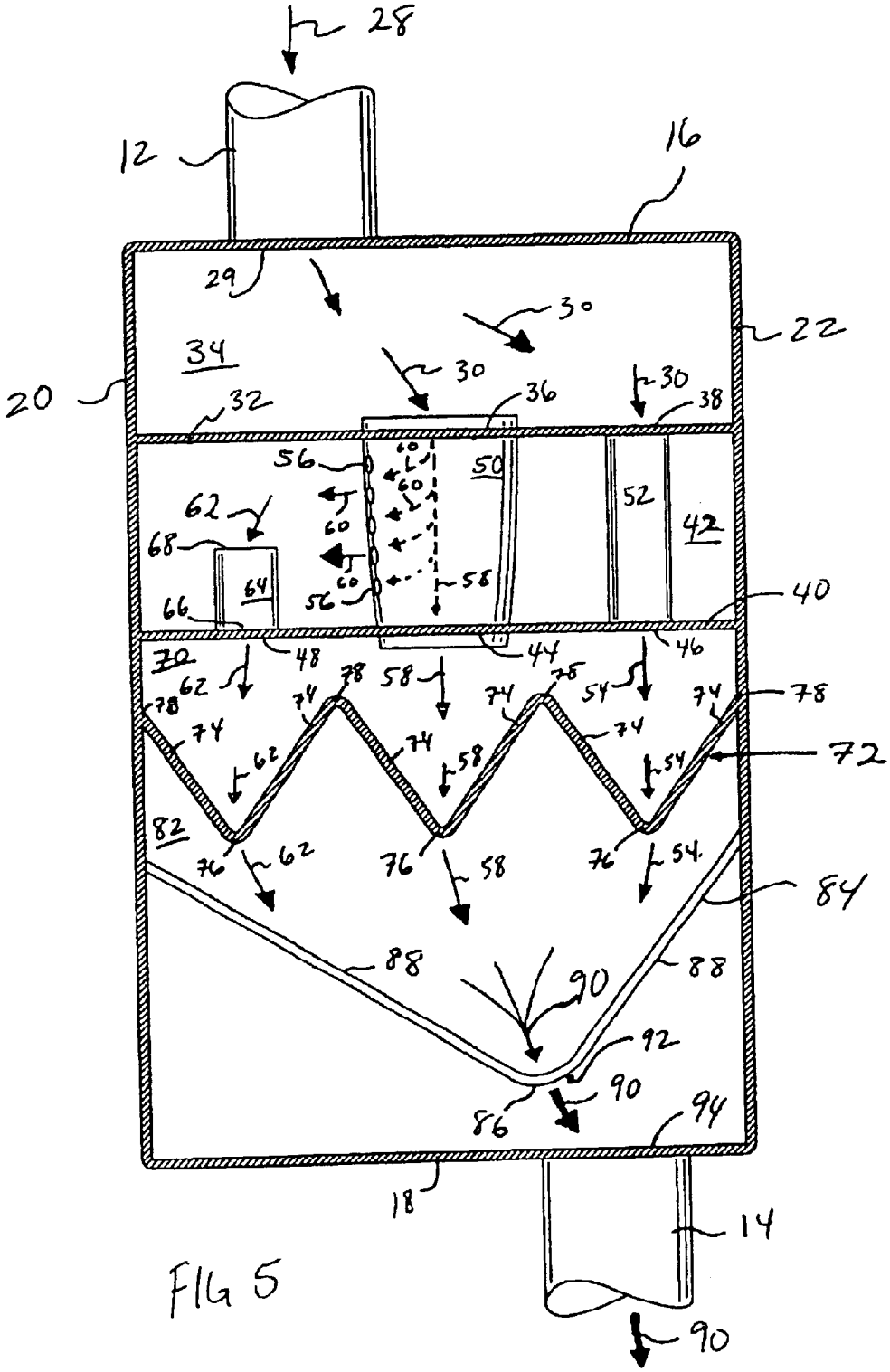
FIG. 5 is a top perspective view of the muffler device with the top thereof removed and illustrating pulse flow.
Figure 7:
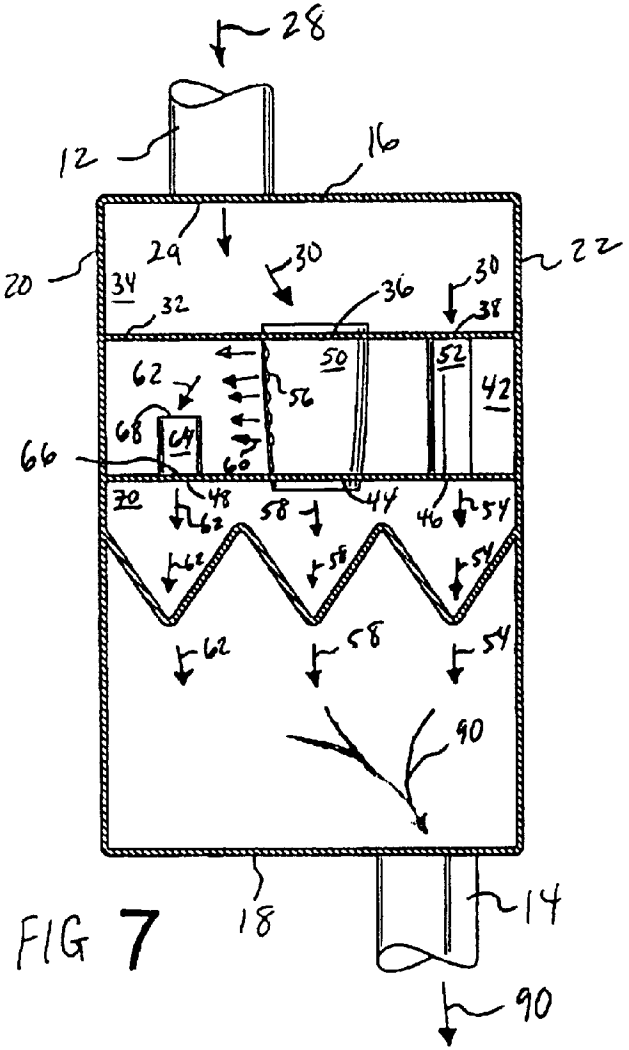
FIG. 7 is a top perspective view of an alternate preferred embodiment of the muffler device also illustrating pulse flow.
Figure 6:
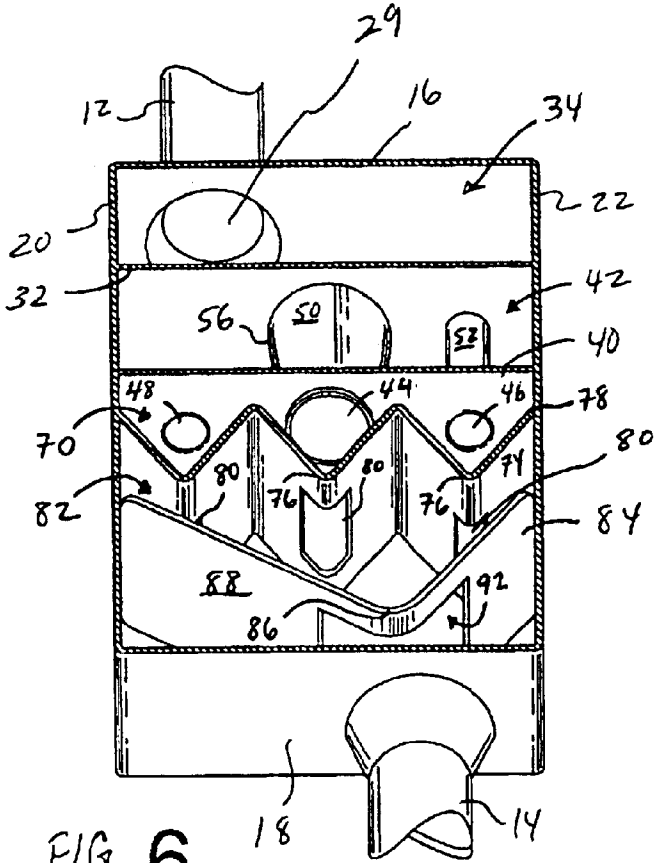
FIG. 6 is a rear top perspective view of the muffler device with the top thereof removed.

Now also referring to FIGS. 5 through 7, arrow 28 illustrates incoming exhaust pulse from an internal combustion engine (not shown) which travels through a first opening 29 defined through inlet wall 16 via inlet conduit 12. At arrows 30, the exhaust pulse is split into two streams as a result of a first barrier 32. First barrier 32 extends between first sidewall 20 and second sidewall 22 and top 24 and bottom 26 such that a first compartment 34 is formed between first barrier 32 and the inlet wall 16. A first aperture 36 and a second aperture 38 are defined through said first barrier 32. In one preferred embodiment, first aperture 36 has a larger diameter than second aperture 38, and both apertures 36 and 38 are not axially aligned with opening 29. In a preferred embodiment, opening 29 is located proximal to first sidewall 20 and first aperture 36 is substantially centrally located within first barrier 32 and second aperture 38 is located proximal to second sidewall 22. It is to be understood that the location of inlet conduit 12 may be altered and as a result the location of first and second apertures 36 and 38 may also be shifted such that axial alignment with opening 29 is avoided. However, second aperture 38 may also be in axial alignment with opening 29 because of its narrower diameter when compared with first aperture 36 without affecting the functioning of device 10.

A second barrier 40 is located more distal to inlet wall 16 than first barrier 32 and also extends between first side wall 20, second side wall 22, top 24 and bottom 26 such that a second compartment 42 is formed between first barrier 32 and second barrier 40. A first hole 44 is defined through second barrier 40 and is in substantial axial alignment with first aperture 36 of first barrier 32. In one preferred embodiment, the diameter of first hole 44 is shorter than the diameter of first aperture 36. A second hole 46 is also defined through second barrier 40 and is in substantial axial alignment with second aperture 38. In one preferred embodiment, the diameter of second hole 46 and second aperture 38 are substantially equal, but may also be of differing size without departing from the essence of the invention. A third hole 48 is also defined through second barrier 40 and is located between first hole 44 and first sidewall 20. In one preferred embodiment, third hole 48 is smaller in diameter than first hole 44 and is substantially the same size as second hole 46.

A first conduit 50 extends from first barrier 32 to second barrier 40 and is aligned between first aperture 36 and first hole 44. A second conduit 52 extends form first barrier 32 to second barrier 40 and is aligned between second aperture 38 and second hole 46. The Second conduit 52 receives the exhaust pulse split at arrow 30 at second aperture 38, the pulse travels through conduit 52 and is expelled from second hole 46 as indicated by arrow 54.

First conduit 50 receives the exhaust pulse that is split at arrow 30 at first aperture 36 and the pulse travels into conduit 50. Within conduit 50, a plurality of voids 56 are created along the axis thereof on a side opposing conduit 52. The diameter of each void 56 is approximately one eighth of an inch, however it is to be understood that the diameter of the void may be altered or the number of voids 56 may be added or subtracted without departing from the essence of the invention. As a result of the voids 56, the exhaust pulse 30 is further split into two streams wherein the pulse traveling out of conduit 50 through first hole 44 is represented by arrow 58 and the pulse traveling out of conduit 50 through voids 56 are represented by arrow 60. The pulse stream indicated by arrows 60 enters second compartment 42, wherein they are brought back together at a point indicated by arrow 62.

A third conduit 64 extends from second barrier 40 at a first end 66 and has a second end 68 distal thereto. Second end 68 receives the exhaust pulse indicated at arrow 62 within second compartment 42 and allows communication between second compartment 42 and a third compartment 70. The exhaust pulse 62 is expelled from third conduit 64 into third compartment 70.

A third barrier 72 and second barrier 40 define third compartment 70, wherein third barrier 72 is located more proximal to outlet wall 18 than second barrier 40. Third barrier 72 preferably extend between first side wall 20 and second side wall 22. In addition, top 24 and bottom 26 rest upon third barrier 72 and help define third compartment 70. Third barrier 72 is preferably made of a plurality of divergently tapering planar surfaces 74 oriented in substantially vertical planes and connected at an apex 76 positioned at substantially the center of the respective pulse stream of exhaust gases discharged from second compartment 40. The planar surfaces 74 are also connected at a base 78 thereof wherein the most distal planar surfaces 74 are connected to first side wall 20 and second side wall 22 respectively. The planar surfaces 74 are arranged to form substantially V-shaped walls that are interconnected such that the base 78 of the planar surfaces are proximal to second barrier 40 and the apex 76 is distal thereto.

The three exhaust pulse streams denoted by arrows 54, 58, and 62 emanate from holes 46, 44, and 48 respectively into third compartment 70. As a result of the arrangement of the planar surfaces 74, the exhaust pulse streams are directed to the apexes 76 of the third barrier 72. At each apex 76 of the third barrier 72 a cavity 80 is defined therein. Each cavity 80 may be of the same sized opening, but in a preferred embodiment, the cavity 80 located on the central apex 76 is substantially twice as large as each of the cavities 80 located on the laterally located apexes 76, such that the central cavity 80 is equivalent to the sum of the laterally located cavities 80.

The three exhaust pulse streams denoted by arrows 54, 58 and 62 travel through the third compartment 70 and out of the cavities 80 located on apexes 76 into a fourth compartment 82. A fourth barrier 84 extends between first side wall 20 and second side wall 22 and also extends between top 24 and bottom 26 to form the fourth compartment 82 in cooperation with third barrier 72. Fourth barrier 84 is substantially concave and therefore has a peak 86 formed by the attachment of fourth planar surfaces 88. Peak 86 is more distal to third barrier 72 than the point of attachment of the fourth planar surfaces 88 to first and second side walls 20 and 22. As such, the three pulse streams 54, 58 and 62 within the fourth compartment are recombined at a point proximal to the peak 86 as denoted by arrow 90. An orifice 92 is defined on fourth barrier 84 at peak 86 such that the united exhaust pulse stream 90 travels there through and is led to a second opening 94 defined on outlet wall 18. The pulse stream 90 travels out of the second opening 94, through outlet conduit 14 and into the atmosphere. However, it is to be understood that orifice 92 may be made of any other shape, such as circular, and the size of the orifice 92 may be modified in accordance with the size of the muffler device 10.

For purposes of illustration and not limitation, muffler device 10 having one preferred dimension will be set forth herein. It will be understood that modifications may be made to the same without departing from the essence of the invention. Device 10 may have an inlet and outlet conduit 12 and 14 having a diameter of 2.25 inches. Accordingly, the walls 16, 18, 20, and 22 have a height of 4 inches. The device 10 has a length and width of 13 inches and 9 inches, respectively. First aperture 36 has a diameter 2.25 inches and the first hole 44 has a diameter of 2 inches. Second aperture 38, second hole 46, and third hole 48 each have a diameter of approximately on inch. Central cavity 80 located on central apex 76 has substantially equal sides of 2 inches and the lateral cavities 80 each have equal sides of 1 inch defining the same. The orifice 92, in a preferred embodiment, is substantially square shaped with each side measuring approximately 2.25 inches. Now referring specifically to FIG. 7, in an alternate preferred embodiment, the fourth barrier 84 may be eliminated such that the three pulse streams indicated by arrows 54, 58, and 62 converge to form pulse stream 90 as a result of the expulsion of the exhaust stream through second opening 94.

The illustrated muffler device 10 was mounted onto a 1965 Ford Mustang automobile having a V8, 2.89 liter engine and the horse power produced by the attachment of the device 10 was measured by the Clayton 400 h.p. machine. The device 10, when attached to the vehicle, produced 120 horse power at 4500 rpm, at 90 miles per hour. The same vehicle was then used to test the three chamber Flowmaster muffler sold as part #42553 by Flowmaster, Inc., Santa Rosa, Calif. The Flowmaster muffler, when attached to the vehicle, produced 110 horse power at 4500 rpm, at 90 miles per hour. In addition, when a flow rate test was conducted to measure the back pressure between the device 10 and the Flowmaster muffler at 28" column of mercury test pressure, they both had an equal Cubic Feet per Minute (CFM) test result of 216.

In addition, while a sound spectrum analyzer was not available for use in analyzing the frequencies which produced the overall relative loudness of the tested devices, subjective observation of the sound indicated that the muffler device 10 of the instant invention had a much more pleasing combination of resultant sound frequencies as compared to the muffler obtained from Flowmaster. Although quantitative measurements are not possible without a sound spectrum analyzer, it was clear from subjective or qualitative listening by observers that the frequency spectrum of sound emitted from the device 10 could be varied by positioning intermediate the barriers 32, 40, 72, and 84 closer or farther away from inlet wall 16. It is believed that the shape and location of the barriers 32, 40, 72 and 84 can be varied to tune the muffler to attenuate undesirable sound frequencies and permit more acceptable frequencies, all without substantially increasing, and in fact decreasing, the muffler back pressure.

It is hypothesized that several phenomena account for the performance enhancement produced by the muffler device 10. First, the sound components entering device 10 are initially relatively entrained in and coaxial with the entering exhaust gases. As they impinge upon first barrier 32, however, they become reflected from the first barrier 32 and increasingly diverge from or become transverse to the flow of the exhaust gases. As the exhaust gases move first compartment 34, it is believed that a substantial number of sound components will be reflected. Thus, sound components reverberate back and forth between interior surfaces defined by within first compartment 34 and tend to cancel or attenuate each other out.

It is further hypothesized that the reduction in back pressure in the muffler device 10 could be the result of any one of three possible sources. First, it will be seen, especially in FIG. 5, that exhaust gas flow must partition immediately in order to proceed the second compartment 42. The exhaust stream indicated by arrow 58 is immediately once again partitioned in second compartment 42. Upon entry into the third compartment 70, three exhaust streams are created which are then rejoined in fourth compartment 82. Accordingly, as a result of the redirection of the exhaust streams, a lower back pressure may be achieved.

A second phenomena which may be occurring is that, as exhaust gases pass from first compartment 34 to second compartment 42, there may be venturi effect with respect to the volume thereof in the second compartment 42 that lowers the pressure therein. This lower pressure has a scavenging effect which causes the muffler back pressure to be relatively low. However, the lower pressure of the second compartment does not result in a build-up of unignited fuel because live fire from the first compartment 34 may easily be transmitted to the second compartment because of the design of first conduit 50.

Finally, the addition sound attenuation or cancellation produced may be causing a pressure drop.

While the above description contains many specificities, these should not be construed as limitations on the scope of the invention, but rather as exemplifications of preferred embodiments thereof. Many other variations are possible without departing from the essential spirit of this invention. Accordingly, the scope of the invention should be determined not by the embodiments illustrated, but by the appended claims and their legal equivalents.

What is claimed is:

1. A muffler device, comprising:

an enclosure having an inlet conduit through which exhaust gases are received within said enclosure, and an outlet conduit through which said exhaust gases are expelled from the enclosure;

a first barrier located within said enclosure and proximal to said inlet conduit such that a first compartment is formed between said first barrier and an inlet wall of said enclosure;

a first aperture and a second aperture being defined through said first barrier, whereby said exhaust gases are split into two streams;

a second barrier is located more distal to said inlet conduit than said first barrier and a second compartment is created between said first and second barriers, said second barrier further comprising a first hole being defined on said second barrier and said first hole being axially aligned with said first aperture, whereby a first conduit extends between said first aperture and said first hole;

a second hole being defined on said second barrier and said second hole being axially aligned with said second aperture, whereby a second conduit extends between said second aperture and said second hole;

a third aperture being defined through said second barrier and said first conduit has at least a void defined therein such that the exhaust stream traveling through said first conduit is further divided into two exhaust streams wherein one stream exits into said second compartment through said void and out of said third aperture, and one stream travels through said first conduit and out of said first hole;

whereby the split exhaust streams are rejoined at a point proximal to said outlet conduit before being expelled therefrom.

2. The device of claim 1, wherein said first conduit has a plurality of voids defined therein, and wherein said first conduit has a larger diameter at said first aperture than at said first hole.

3. The device of claim 1, wherein said second conduit has a smaller diameter than said first conduit;

a third conduit extends partially into said second compartment from said third hole of said second barrier, and allows passage of an exhaust stream there through;

said third conduit having substantially the same diameter as said second conduit.

4. The device of claim 1, wherein a third barrier is located more distal to said inlet wall than said second barrier such that a third compartment is formed between said second barrier and said third barrier;

said third barrier having at least one cavity defined there through such that the three exhaust streams are passed there through and expelled from said outlet conduit.

5. The device of claim 4, wherein said third barrier has a first cavity, a second cavity, and a third cavity that are axially aligned with said first hole, second hole, and third hole, respectively;

whereby said three exhaust streams pass through said first hole, second hole, and third hole, respectively and are rejoined at a point distal thereto before passing through said outlet conduit.

6. The device of claim 1, wherein a third barrier is located more distal to said inlet wall than said second barrier such that a third compartment is formed between said second barrier and said third barrier;

said third barrier being formed by a plurality of planar surfaces such that at least three apexes are formed distal to said second barrier and proximal to said outlet conduit;

said plurality of planar surfaces also forming a base at each conjunction there between and at the conjunction between the planar surfaces and the side walls of said enclosure, wherein the bases are more proximal to said second barrier and distal to said apexes;

a cavity located on each of the apexes for passage of the exhaust gas streams there through.

7. The device of claim 6, wherein said three apexes are substantially axially aligned with said first bole, second hole, and third hole, respectively.

8. The device of claim 6, wherein a fourth barrier is placed between said third barrier and said outlet conduit;

said fourth barrier having a substantially concave shape such that a fourth planar surface defines a peak therein, said peak being more proximal to said outlet conduit than a point of attachment of said planar surfaces to the side walls;

an orifice being defined through said peak;

whereby, the three exhaust streams are combined into one stream at said peak and pass through said orifice and out of said outlet conduit.

9. A muffler device for an internal combustion engine, comprising:

an enclosure having an inlet wall and an opposing outlet wall that are interconnected by a first side wall and a second side wall;

a top and a bottom resting upon the walls on opposing sides of the walls and enclosing the same;

an inlet conduit attaching to said inlet wall whereby a first opening in said inlet wall communicates with said inlet conduit and through which exhaust gases are received within said enclosure, and an outlet conduit through which said exhaust gases are expelled from the enclosure;

a first barrier located within said enclosure and extending between the first and second side walls and being proximal to said inlet conduit such that a first area is formed between said first barrier and the inlet wall of said enclosure;

a first aperture and a second aperture being defined through said first opening, whereby said exhaust gases are split into two streams;

a second barrier is located more distal to said inlet conduit than said first barrier and extending between the first and second side walls such that a second area is created between said first and second barriers, said second barrier further comprising;

a first hole being defined substantially medially on said second barrier and said first hole being axially aligned with said first aperture, whereby a first conduit extends between said first aperture and said first hole;

a second hole being defined on said second barrier and said second hole being axially aligned with said second aperture, whereby a second conduit extends between said second aperture and said second hole;

a third hole being defined on said second barrier on side distal to said second hole;

at least a void defined within said first conduit perpendicular to its axial extension and in a direction opposing said second conduit but opening towards said third hole, such that the exhaust stream traveling through said first conduit is further divided into a second exhaust stream and enters into said second area through said void and leaves the second area through said third hole and one stream continues to travel through said first conduit and out of said first hole;

whereby the split exhaust streams travel through said first and second conduits and said third hole and are rejoined into one stream before exiting said outlet conduit.

10. The device of claim 9, wherein said first conduit and first aperture have a larger diameter at said first barrier than the diameter of said first hole at said second barrier and said first conduit has a plurality of voids.

11. The device of claim 9, wherein said second conduit has a smaller diameter than said first conduit;

a third conduit extends partially into said second area from said third hole of said second barrier, and allows passage of an exhaust stream there through and out of said third hole;

said third conduit having substantially the same diameter as said second conduit.

12. The device of claim 11, wherein a third barrier is located more distal to said inlet wall than said second barrier such that a third area is formed between said second barrier and said third barrier;

a first cavity, a second cavity, and a third cavity defined on said third barrier and are axially aligned with said first hole, second hole, and third hole, respectively;

whereby said three exhaust streams pass through said first hole, second hole, and third hole, respectively and are rejoined at a point distal thereto before passing through said outlet conduit.

13. The device of claim 11, wherein a third barrier is located more distal to said inlet wall than said second barrier such that a third area is formed between said second barrier and said third barrier;

said third barrier being formed by a plurality of planar surfaces such that at least three apexes are formed distal to said second barrier and proximal to said outlet conduit;

said plurality of planar surfaces also forming a base at each conjunction there between and at the conjunction between the planar surfaces and the first and second side walls of said enclosure, wherein the bases are more proximal to said second barrier and distal to said apexes;

a cavity located on each of the apexes for passage of the exhaust gas streams there through.

14. The device of claim 13, wherein said three apexes are substantially axially aligned with said first hole, second hole, and third hole, respectively.

15. The device of claim 13, wherein a fourth barrier is placed between said third barrier and said outlet conduit;

said fourth barrier having a substantially concave shape such that a fourth planar surface defines a peak therein, said peak being more proximal to said outlet conduit than a point of attachment of said planar surfaces to the side walls;

an orifice being defined through said peak;

whereby, the three exhaust streams are combined into one stream at said peak and pass through said orifice and out of said outlet conduit.

16. A muffler device for an internal combustion engine, comprising:

an enclosure having an inlet wall and an opposing outlet wall that are interconnected by a first side wall and a second side wall;

a top and a bottom resting upon the walls on opposing sides of the walls and enclosing the same;

an inlet conduit attaching to said inlet wall and communicating with a first opening defined through said inlet wall, exhaust gases travel through said inlet conduit and enter into said enclosure through said first opening;

an outlet conduit through which said exhaust are expelled from the enclosure;

a first barrier located within said enclosure and extending between the first and second side walls and being proximal to said inlet conduit such that a first area is formed between said first barrier and the inlet wall of said enclosure;

a first aperture and a second aperture being defined through said first opening, whereby said exhaust gases are split into two streams;

a second barrier is located more distal to said inlet conduit than said first barrier and extending between the first and second side walls such that a second area is created between said first and second barriers;

a first hole being defined substantially medially on said second barrier and said first hole being axially aligned with said first aperture, whereby a first conduit extends between said first aperture and said first hole;

a second hole being defined on said second barrier and said second hole being axially aligned with said second aperture, whereby a second conduit extends between said second aperture and said second hole;

a third hole being defined on said second barrier on a side distal to said second hole;

at least a void defined within said first conduit perpendicular to its axial extension and in a direction opposing said second conduit but opening towards said third hole, such that the exhaust stream traveling through said first conduit is further divided into a second exhaust stream and enters into said second area through said void and leaves the second area through said third hole and one stream continues to travel through said first conduit and out of said first hole;

whereby the split exhaust streams travel through said first and second conduits and said third hole end are rejoined into one stream before exiting said outlet conduit.

17. The device of claim 16, wherein a third barrier is located more distal to said inlet wall than said second barrier such that a third area is formed between said second barrier and said third barrier;

said third barrier being formed by a plurality of planar surfaces such that at least three apexes are formed distal to said second barrier and proximal to said outlet conduit;

said plurality of planar surfaces also forming a base at each conjunction there between and at the conjunction between the planar surfaces and the first and second side walls of said enclosure, wherein the bases are more proximal to said second barrier and distal to said apexes;

a cavity located on each of the apexes for passage of the exhaust gas streams there through;

a fourth barrier is placed between said third barrier and said outlet conduit such that a fourth area is formed where the three exhaust gas streams are expelled from the cavities is received;

said fourth barrier having a substantially concave shape such that a fourth planar surface defines a peak therein, said peak being more proximal to said outlet conduit than a point of attachment of said planar surfaces to the side walls;

an orifice being defined through said peak;

whereby, the three exhaust streams are combined into one stream at said peak and pass through said orifice and out of said outlet conduit.

* * * * *